US005585911A

United States Patent [19]

Hattori et al.

[11] Patent Number: 5,585,911

[45] Date of Patent: Dec. 17, 1996

[54] DRIVE DEVICE FOR A ROTARY DEVELOPING UNIT

[75] Inventors: Ryuji Hattori; Makoto Katayama; Shigemi Murata, all of Kanagawa, Japan

[73] Assignee: Fuji Xerox Co., Ltd., Tokyo, Japan

[21] Appl. No.: 515,212

[22] Filed: Aug. 15, 1995

[30] Foreign Application Priority Data

Aug. 16, 1994 [JP] Japan ..... 6-213236
Aug. 19, 1994 [JP] Japan ..... 6-195069

[51] Int. Cl.[6] ..... G03G 15/00; G03G 15/01; G03G 15/08

[52] U.S. Cl. ..... 355/326 R; 118/645; 355/200; 355/208; 355/245

[58] Field of Search ..... 355/326 R, 327, 355/208, 245, 200; 118/645

[56] References Cited

U.S. PATENT DOCUMENTS

| | | | |
|---|---|---|---|
| 4,615,612 | 10/1986 | Ohno et al. | 355/245 |
| 4,743,938 | 5/1988 | Ohno | 355/327 |
| 5,182,584 | 1/1993 | Fukunaga et al. | 355/245 X |
| 5,325,151 | 6/1994 | Kimura et al. | 355/200 |
| 5,412,457 | 5/1995 | Kawano et al. | 355/245 |
| 5,436,697 | 7/1995 | Negishi | 355/208 |
| 5,471,292 | 11/1995 | Okazawa | 355/326 R |

FOREIGN PATENT DOCUMENTS

| | | |
|---|---|---|
| 61-99169 | 5/1986 | Japan . |
| 61-151564 | 7/1986 | Japan . |
| 61-128375 | 5/1988 | Japan . |

*Primary Examiner*—Arthur T. Grimley
*Assistant Examiner*—Sophia S. Chen
*Attorney, Agent, or Firm*—Finnegan, Henderson, Farabow, Garrett & Dunner, L.L.P.

[57] ABSTRACT

A drive device for a rotary developing unit of the type in which a plural number of developing subunits are mounted on a rotary body, and a drive means is provided outside the rotary body, and in operation the developing subunits are successively moved to their developing positions when the rotary body is turned, and the developing subunit is driven by the drive means at its developing position, is improved in that the drive means drives the developing subunit for a specific period of time from a time point just before the developing subunit is moved to a predetermined developing position and stops thereat to another time point immediately after the developing subunit leaves the developing position.

19 Claims, 12 Drawing Sheets

DRIVE DEVICE FOR A ROTARY DEVELOPING UNIT

BACKGROUND OF THE INVENTION

The present invention relates to a multi-color image forming apparatus based on the xerography process, such as a copying machine, a facsimile machine, or a printer. More particularly, the invention relates to a drive device for a rotary type developing unit which has a plural number of developing subunits arrayed around a rotary body, and is capable of developing toner images of at least two colors.

In a color image forming process by a multi-color image forming apparatus based on the xerography process, a photoreceptor is uniformly charged. Latent electrostatic images of four colors, black, yellow, magenta, and cyan are formed on the surface of the charged photoreceptor in successive order. These electrostatic images are developed into toner images of those colors by the developing subunits for these colors, which are arrayed around a rotary body. The developed toner images are transferred onto a paper being transported by a transfer drum, which is being turned in proximity with an image bearing means. Through four turns of the transfer drum, the toner images of four colors are superposedly transferred onto the paper. The resultant image is a color image of four colors. (For this multi-color image forming apparatus, reference is made to Published Unexamined Japanese Patent Application No. Sho. 63-128375.)

The developing subunit includes a developing roll disposed in proximity with the photoreceptor, a magnet roll for forming a plurality of magnetic patterns, and a developing sleeve rotatably supported around the magnet roll. Developer is attracted to the surface of the developing sleeve by a magnetic force developed by the magnet roll. As a result, magnetic carriers are raised to form a magnetic brush. With rotation of the developing sleeve, the magnetic brush on the surface thereof is transported to a developing region where the developing sleeve faces the photoreceptor. In this region, the magnetic brush is made close to or to contact with the photoreceptor. At this time, a bias voltage is applied between the developing roll and the photoreceptor. A potential acting such that the charged toner is attracted to the photoreceptor, is set up between an image forming area on the photoreceptor and the developing roll. A potential acting such that toner is attracted to the surface of the developing roll, is set up between a nonimage forming area and the developing roll. In this state, the charged toner is transferred to only the image forming area on the photoreceptor, to thereby visualize the latent electrostatic image.

FIGS. 12 to 14 cooperate to show a conventional rotary developing unit. Of those figures, FIG. 12 is a sectional view of the developing unit when seen from one side. FIG. 13 is a side view, partly in cross section, showing a drive system for the developing unit. FIG. 14 is a timing diagram showing the operation of the developing unit. In FIGS. 12 and 13, the rotary developing unit includes four developing subunits 2*a* to 2*d*, which are equidistantly arrayed along the circumference of a rotary body 7. The rotary body 7 is rotatably supported by a rotary shaft 7*a*, which is supported on a main frame of the rotary developing unit 1. The rotary body 7 thus supported may be turned by a drive motor, not shown, in the direction of an arrow in the drawing. A photoreceptor drum 8 is disposed in proximity with and faces the rotary body 7, and is turned by a drive motor, not shown, in the direction of an arrow shown in the figure.

A clutch 12 for driving the developing unit is mounted on a bracket 11 of an apparatus body frame 10. A power is transmitted from the photoreceptor drive motor to the clutch 12, through a belt 13. A drive shaft 15, supported on the body frame 10 through a bearing 14 placed therebetween, is inserted into the clutch 12. The power is transmitted to the drive shaft 15 through the on/off operation of the clutch 12. A gear G0 for driving the developing subunit is fastened onto the end of the drive shaft 15. A follower gear G3 is in mesh with the gear G0. The follower gear G3 is supported by a support shaft 18 through a bearing 21 placed therebetween. The support shaft 18 is fastened to a bracket 25 that is mounted on the rotary body 7. A rotation of the follower gear G3 is transferred to a follower gear G4, a developing roll drive gear G5, a follower gear G6, a developer agitating/transporting auger drive gear G7, a follower gear G8, and a developer agitating/transporting auger G9, in this order. With the rotation of these gears, a developing roll, not shown, is turned.

The operation of the rotary developing unit thus constructed will be described with reference to FIG. 14.

(A) The drive motor for the rotary body 7 is turned on ((1) in FIG. 14).

(B) The rotary body 7 moves a first developing subunit to its developing position, and stops it thereat. After completion of the developing operation by the first developing subunit, the rotary body 7 moves a second developing subunit to its developing position, and stops it thereat ((2) in FIG. 14).

(C) This operation is repeated for the remaining third and fourth developing subunits, thereby developing a full color image.

(D) The clutch 12 is put in a coupling state at a time point y1 after the developing subunit reaches its developing position, and is turned off at a time point x1 just before the developing subunit leaves the developing position. The same thing is correspondingly applied to the application and removal of the bias voltage ((3) and (4) in FIG. 14).

The rotary developing unit is constructed such that no drive force is applied to the developing roll as a developer bearing means only when the developing subunit is moved on its circular path and reaches its developing position. Therefore, such a state that the developer bearing means rolls to a standstill at the developing position, and faces the photoreceptor while being in proximity with the latter, is set up in the rotary developing unit. In this state, developer at the developing nip of the developer bearing means where it faces the photoreceptor is stuck onto the surface of the developer bearing means. The developer stuck thereonto appears as streaks in the reproduced image.

Moreover, in the conventional control method for controlling the application of a bias voltage, a preset rotation time of the rotary body that is previously computed is frequently incoincident with an actual rotation time thereof. This results in degradation of image quality, e.g., fog appearing on the reproduced image and carrier being stuck onto the image bearing means.

The image forming speed of the recent image forming apparatus is increased. With increase of the image forming speed, a rotation speed of the image bearing means becomes higher, so that a high speed movement of the developing unit is required. In this circumstance, the application of the bias voltage to the developing subunits must be more accurately timed. Where an image forming area on the image bearing means is limited in accordance with the size of a paper used, use of the two-component developer arises a problem when the developing subunit is placed to face the nonimage forming area of the image bearing means. That is, in such a situation, carriers of the developing subunit are scattered onto the nonimage forming area, to possibly damage the surface of the image bearing means. To cope with this problem, there is a proposal that the rotation speed of the rotary body is controlled in accordance with the size of the paper so as to prevent each developing subunit from facing the nonimage forming area of the image bearing means. The proposal makes the control of the bias voltage application more intricate.

SUMMARY OF THE INVENTION

The present invention has been made in view of the above circumstances and has an object to provide a rotary developing unit which prevents developer from sticking onto the developer bearing means when the developer bearing means rolls to a standstill at the developing position and faces the photoreceptor while being in proximity with the latter, whereby eliminating the streak problem which otherwise would be caused in the developing stage.

A drive device for a rotary developing unit of the type in which a plural number of developing subunits are mounted on a rotary body, and a drive means is provided outside the rotary body, and in operation the developing subunits are successively moved to their developing positions when the rotary body is turned, and the developing subunit is driven by the drive means at its developing position, is improved in that the drive means drives the developing subunit for a specific period of time from a time point just before the developing subunit is moved to its predetermined developing position and stops thereat to another time point immediately after the developing subunit leaves the developing position. A voltage applying means may be provided, which applies a given voltage to the developer bearing means when the developing subunit is driven.

In the present invention, when the motor for driving the rotary body is operated and stopped, the rotary body 7 is moved to the developing position and stopped thereat. Upon completion of the developing operation, the next developing subunit is moved to its developing position. This operation is repeated for the remaining developing subunits. The gear for driving the developing subunit engages it each other just before the rotary body is rotated and the developing subunit reaches its developing position, and disengages from it immediately after the developing subunit leaves the developing position.

Moreover, another object of the present invention is to provide an image forming apparatus which is capable of precisely controlling the timings of the application of the bias voltage to the developing subunits of a developing unit, and a method of controlling the application of a developing bias voltage.

The image forming apparatus of one embodiment uses the stepping motor, not a normal motor, for driving for rotation the rotary body carrying the plural number of developing subunits thereon. Therefore, the number of pulses of a control signal for driving the stepping motor exactly defines the quantity of rotation of the rotary body. The number of the pulses of the control signal is counted by the pulse counter. The application of the bias voltage is controlled in accordance with the count value outputted from the pulse counter. Therefore, when the developing subunit reaches a predetermined position on its circular moving path, the application and removal of the developing bias voltage to and from the developing subunit can exactly be controlled simultaneously with the drive of the developing roll.

Also in such a control that the rotation speed of the rotary body is varied in accordance with the paper size, the control exactly corresponding to the quantity of rotation of the rotary body is possible without intricate settings since the timing of the application of the bias voltage is controlled in accordance with the rotation quantity of the stepping motor.

The image forming apparatus of another embodiment includes a rotation quantity detecting means for detecting a quantity of rotation of said rotary body or said stepping motor. The detect value from the rotation quantity detecting means is compared with a rotation quantity that is computed on the basis of the number of pulses inputted to the stepping motor.

Therefore, when an abnormal load acts on the stepping motor, and the motor abnormally operates, it is possible to immediately stop the operation of the developing unit and/or the application of the bias voltage.

DETAILED DESCRIPTION OF THE PREFERRED EMBODIMENTS

The preferred embodiments of the present invention will be described with reference to the accompanying drawings.

Figure 1:
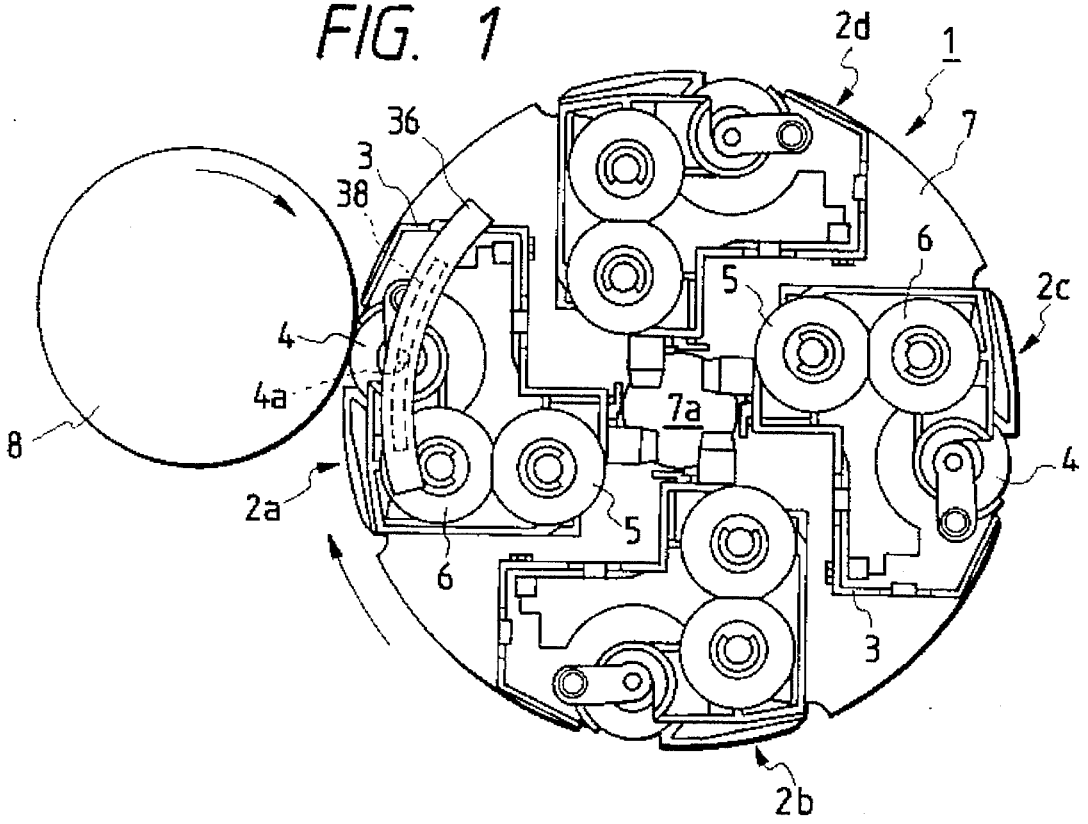
FIG. 1 is a sectional view showing a drive device for driving a rotary developing unit according to the present invention, the view being seen from one side of the developing unit.

In FIG. 1, the rotary developing unit 1 is provided with a cyan developing subunit 2*a*, a magenta developing subunit 2*b*, a yellow developing subunit 2*c*, and a black developing subunit 2*d*. Each of the developing subunits 2*a* to 2*d* includes a developing housing 3, a developer bearing means such as a developing roll 4, and two developer agitating/transporting augers 5 and 6. These developing subunits 2*a* to 2*d* are equidistantly disposed along the circumference of the rotary body 7. The rotary body 7 is rotatably supported by a rotary shaft 7*a*, which is supported on the main frame of the rotary developing unit 1. The rotary body 7 thus supported may be turned by a drive motor, not shown, in the direction of an arrow in the drawing. A photoreceptor drum 8 is disposed in proximity with and faces the rotary body 7, and is turned by a drive motor, not shown, in the direction of an arrow shown in the figure.

Figure 2:
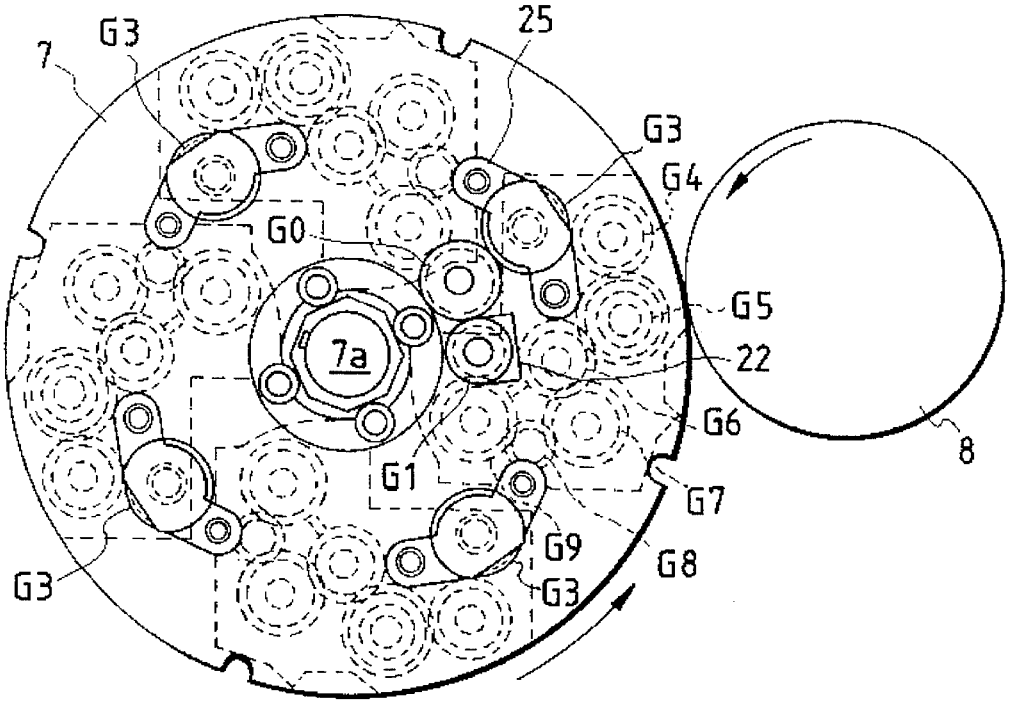
FIG. 2 is a side view of the developing unit when seen from the other side of FIG. 1.
Figure 3:
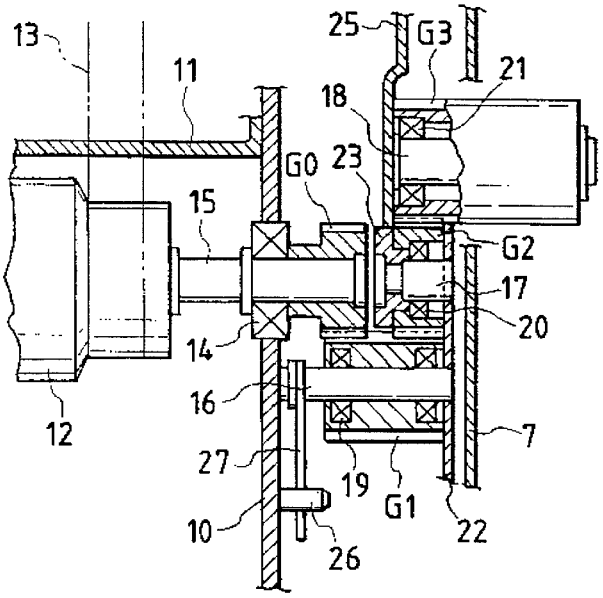
FIG. 3 is a cross sectional view showing a drive system for driving the developing subunit.

In FIGS. 2 and 3, a clutch 12 for driving the developing subunit is mounted on a bracket 11 of the body frame 10. Power is transmitted through a belt 13 to the clutch 12, from a main drive for driving the photoreceptor and the cleaner. A drive shaft 15, supported on the apparatus (e.g., a copying machine) body frame 10 by a bearing 14 placed therebetween, is inserted into the clutch 12. The power is transmitted to the drive shaft 15 through the coupling/decoupling of the clutch 12. A gear G0 for driving the developing subunit is fastened onto the end of the drive shaft 15. A first follower gear G1 is in mesh with the gear G0. The first follower gear G1 is in mesh with a second follower gear G2. The second follower gear G2 is in mesh with a third follower gear G3.

The first follower gear G1 is rotatably supported by a support shaft 16 through a bearing 19 intervening therebetween. The second follower gear G2 is rotatably supported by a support shaft 17 through a bearing 20 intervening therebetween. The third follower gear G3 is rotatably supported by a support shaft 18 through a bearing 21 intervening therebetween. One end of the support shaft 16 for the first follower gear G1 is fastened to the apparatus body frame 10, while the other end thereof is slidably coupled with a bracket 22. The support shaft 17 for the second follower gear G2 is fastened at one end to the bracket 22. A spacer 23 for setting a gap is fastened to the other end of the support shaft 17. The support shaft 18 for the third follower gear G3 is fastened at one end to a bracket 25 mounted on the rotary body 7. The end of the bracket 25 comes in contact with the gap setting spacer 23. A rotation of the third follower gear G3 is transmitted to a follower gear G4, a developing roll drive gear G5, a follower gear G6, a developer agitating/transporting auger drive gear G7, a follower gear G8, and a developer agitating/transporting auger drive gear G9, in this order. With rotation of these gears, the developing roll 4 and the two developer agitating/transporting auger drive gears G7 and G9 are turned.

Figure 4:
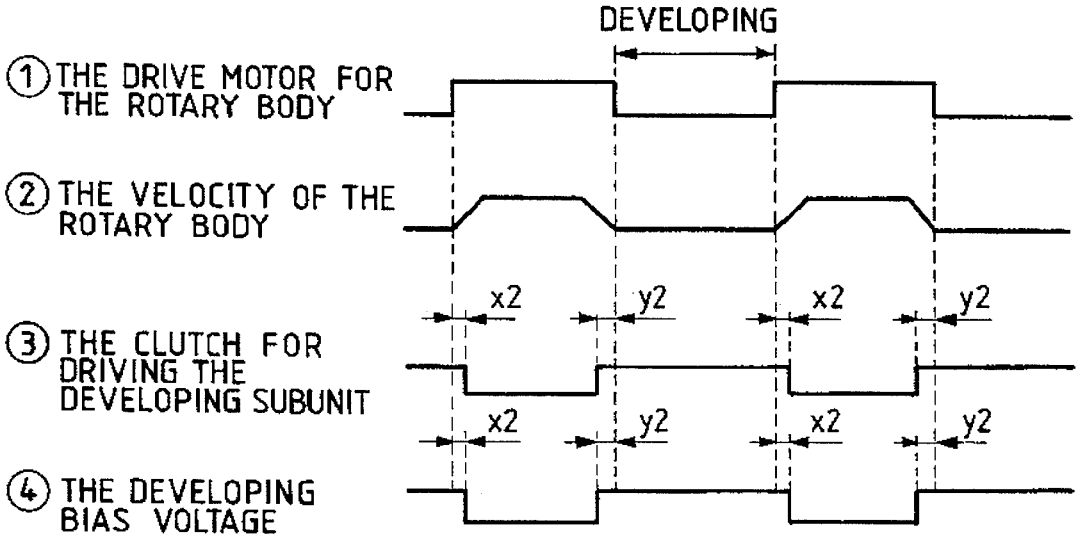
FIG. 4 is a timing chart showing the operation of the rotary developing unit.

FIG. 4 is a timing chart showing the operation of the rotary developing unit thus constructed. FIG. 5 is a view for explaining the operation of the rotary developing unit shown in FIGS. 1 to 3.

(A) The drive motor for the rotary body 7 is turned on ((1) in FIG. 4).

(B) Then, the rotary body 7 moves a first developing subunit to a developing position, and stops it thereat. After completion of the developing operation by the first developing subunit, the rotary body 7 moves a second developing subunit to a developing position, and stops it thereat ((2) in FIG. 4).

(C) This operation is repeated for the remaining third and fourth developing subunits, thereby developing a full color image.

(D) The clutch 12 is put in a coupling state at a time point y2 just before the developing subunit reaches a developing position with rotation of the rotary body 7. The clutch 12 is put in a decoupling state at a time point x2 just after the developing subunit leaves the developing position.

The operation of the rotary developing unit will further be described with reference to FIG. 5. The bracket 22 that supports the second follower gear G2, is supported by the support shaft 16 for the first follower gear G1 in a state that it may be swung. The bracket 22 is also urged in the clockwise direction (as viewed in the drawing) by a spring 27. The spring 27 is supported by a pin 26 projected from the body frame 10 and the support shaft 16 (FIGS. 3 and 5(A)).

Figure 5A:
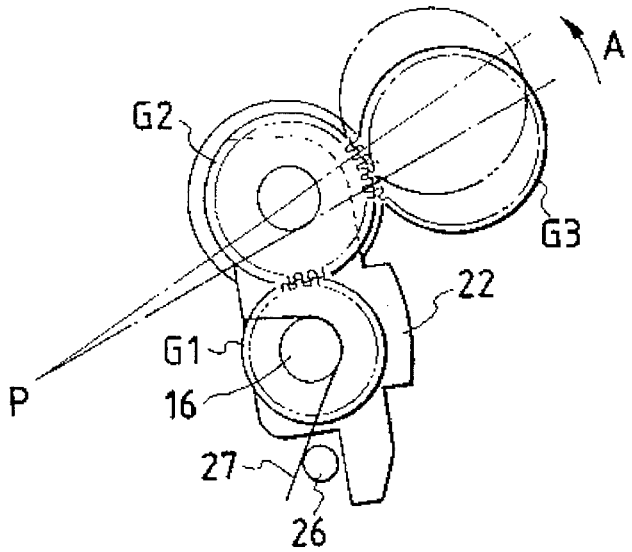
FIGS. 5(A) to 5(C) are views for explaining the operation of the rotary developing unit.

Reference is made to FIG. 5(A). The rotary body 7 is turned in the direction of an arrow A. The third follower gear G3 for driving the developing subunit revolves around the center P. Just before it reaches its developing position (indicated by a circle of a dotted line), the third follower gear G3 is in mesh with the second follower gear G2. The developing-subunit drive clutch 12 is put in a coupling state. In turn, a drive force is transmitted to the developing subunit by a route of the developing-subunit drive gear G0, and the follower gears G1 to G3. When the second follower gear G2 engages the third follower gear G3, the gap-setting spacer 23 that is coaxial with the second follower gear G2 comes in contact with the bracket 25 that supports the third follower gear G3. A power transmission is performed therebetween.

Figure 5B:
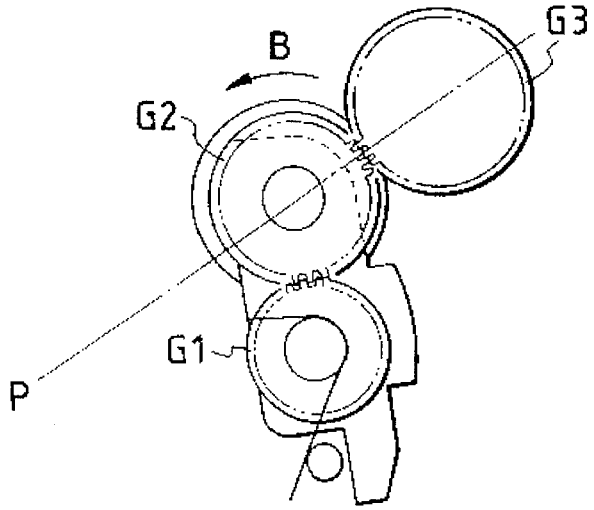
Figure 5C:
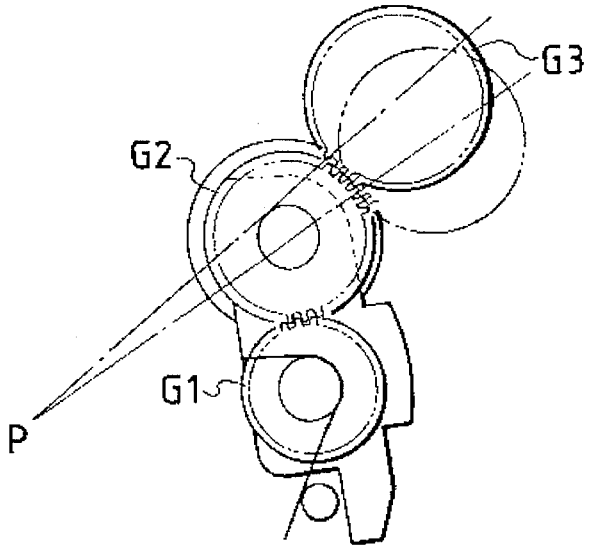

As shown in FIG. 5(B), the third follower gear G3 revolves to reach the developing position. The second follower gear G2 that is supported by the bracket 22 is swung in the direction B about the support shaft 16 while resisting the urging force of the spring 27. The meshing of the third follower gear G3 with the second follower gear G2 is maintained till a time point immediately after the third follower gear G3 revolves to leave the developing position. When the third follower gear G3 disengages from the second follower gear G2, the second follower gear G2 is returned to its original position by the urging force of the spring 27.

Figure 6:
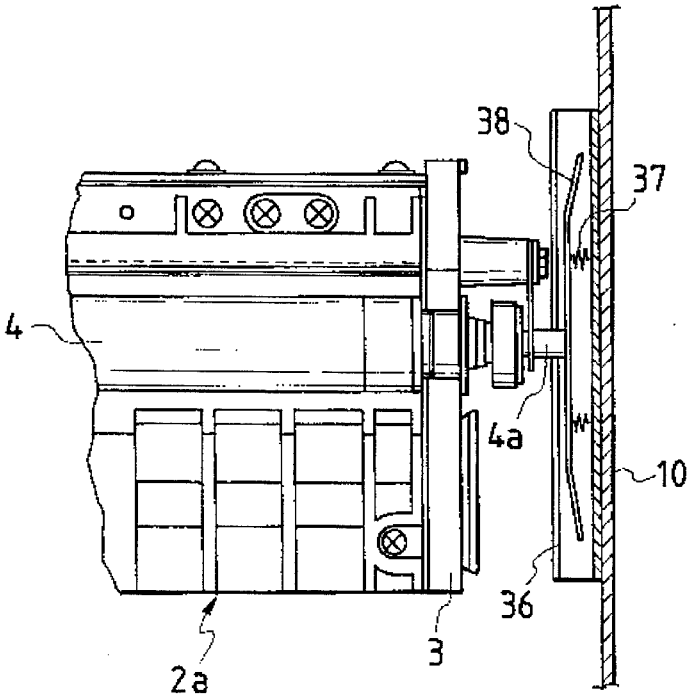
FIG. 6 is a sectional view showing a mechanical construction for realizing the required timings of applying a developing voltage.

The mechanical operation of the drive system for the developing subunit is as described above. The timings of the application of the developing bias voltage are illustrated in (4) of FIG. 4. As shown, the bias voltage is applied at the time point y2 just before the developing subunit reaches a developing position with rotation of the rotary body 7. The bias voltage is removed at a time point x2 just before the developing subunit leaves the developing position. A mechanical construction for realizing the timings of the application of the developing bias voltage will be described with reference to FIG. 6.

As shown, a housing 36 is mounted on the body frame 10. A conductive plate 38 is disposed within the housing 36. Within the housing, the conductive plate 38 is urged by a spring 37. The tip top of the shaft 4*a* of the developing roll 4 in the developing subunit 2*a* is brought into contact with the conductive plate 38. The conductive plate 38 is arcuate along a path of the shaft 4*a* when it moves. With such a construction, the bias voltage is allowed to be applied only when the tip top of the shaft 4*a* of the developing roll 4 is in contact with the conductive plate 38 (FIG. 1).

Figure 7:
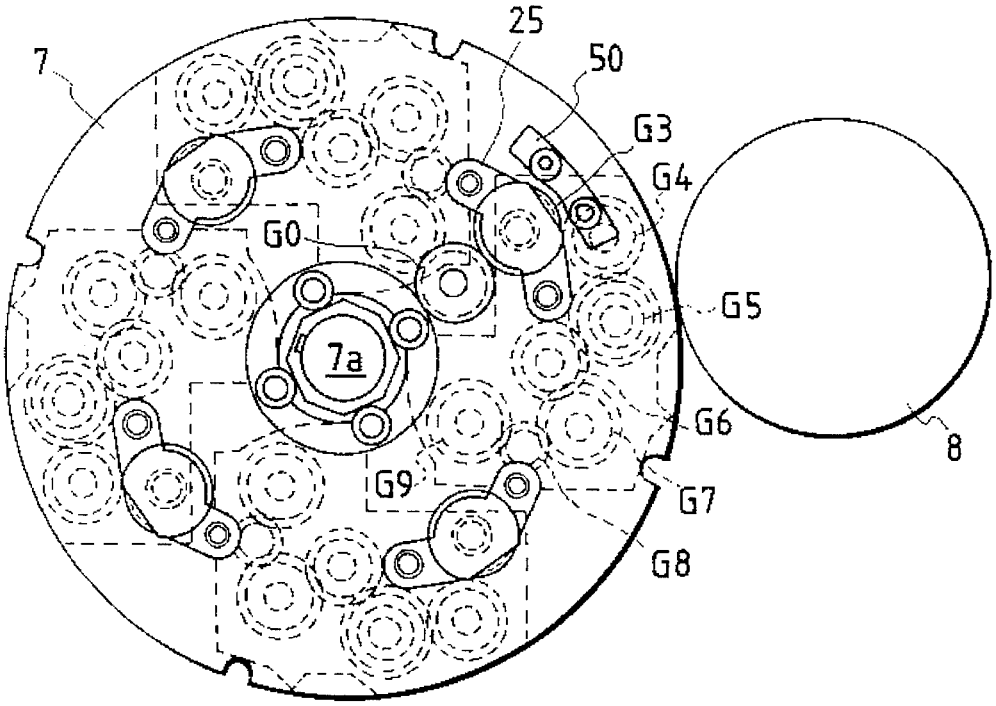
FIG. 7 is a sectional view showing a rotary developing unit according to another embodiment of the present invention.
Figure 8:
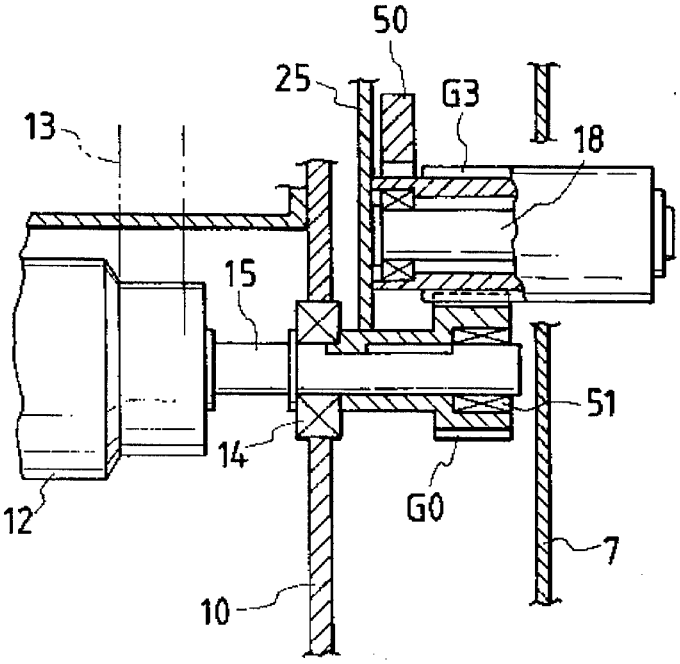
FIG. 8 is a cross sectional view showing a drive system for driving a developing subunit used in the rotary developing unit of FIG. 7.
Figure 9A:
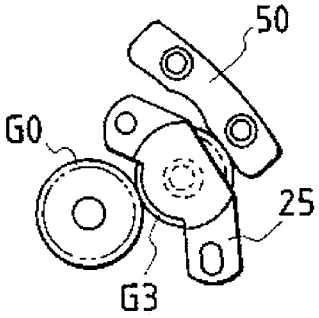
FIGS. 9(A) to 9(C) are views showing the operation of the rotary developing unit shown in FIGS. 7 and 8.
Figure 9B:
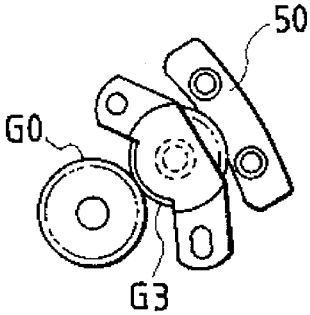
Figure 9C:
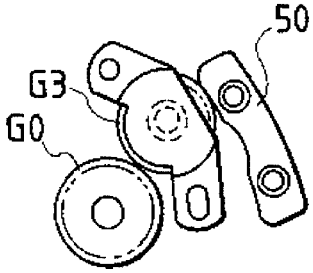

FIGS. 7, 8, and 9 cooperate to show another embodiment of the present invention. FIG. 7 is a view corresponding to that of FIG. 1. FIG. 8 is a cross sectional view showing a drive system for a developing roll used in the rotary developing unit of FIG. 1. FIG. 9 is a view showing the operation of the present embodiment. In those figures, like or equivalent portions are designated by like reference numerals in the figures referred to in the description of the first embodiment.

In the present embodiment, as shown in FIGS. 7 and 8, a developing subunit drive gear G0 is fastened to the tip top of the drive shaft 15, with a bearing 51 intervening therebetween. A follower gear G3 for driving a developing subunit directly engages the drive gear G0. A contact member 50 is disposed for the apparatus body frame 10 such that the follower gear G3 is allowed to come in contact with the contact member 50. Specifically, the follower gear G3 is brought into contact with the contact member 50 at a before-developing position (FIG. 9(A)), an developing position (FIG. 9(B)), and an after-developing position (FIG. 9(C)). The transmission of a drive force is performed when the follower gear G3 is in contact with the contact member 50.

Figure 10:
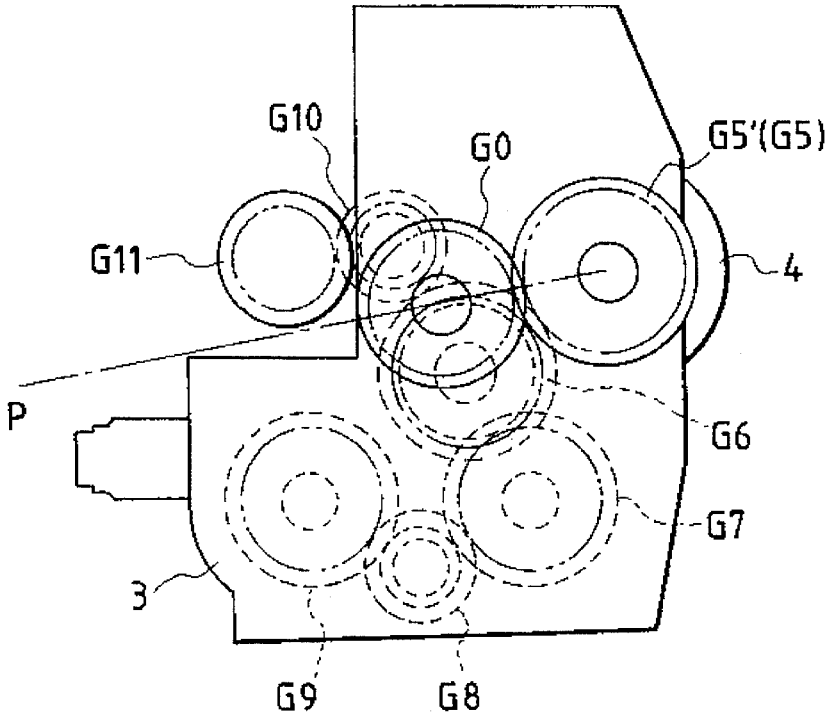
FIG. 10 is a side view showing a modification of the drive system for the developing subunit.
Figure 11:
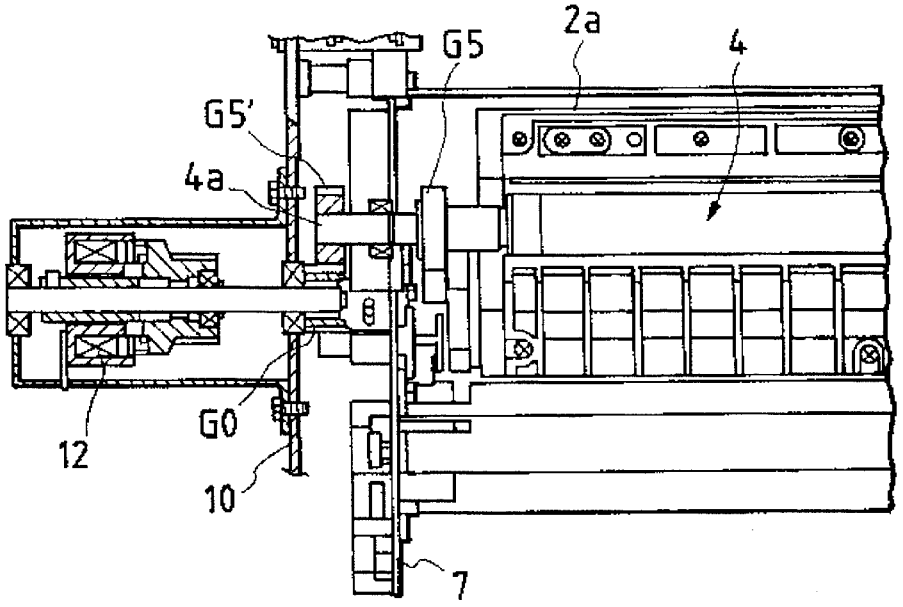
FIG. 11 is a front view, partly in cross section, showing the drive system of FIG. 10.
Figure 12:
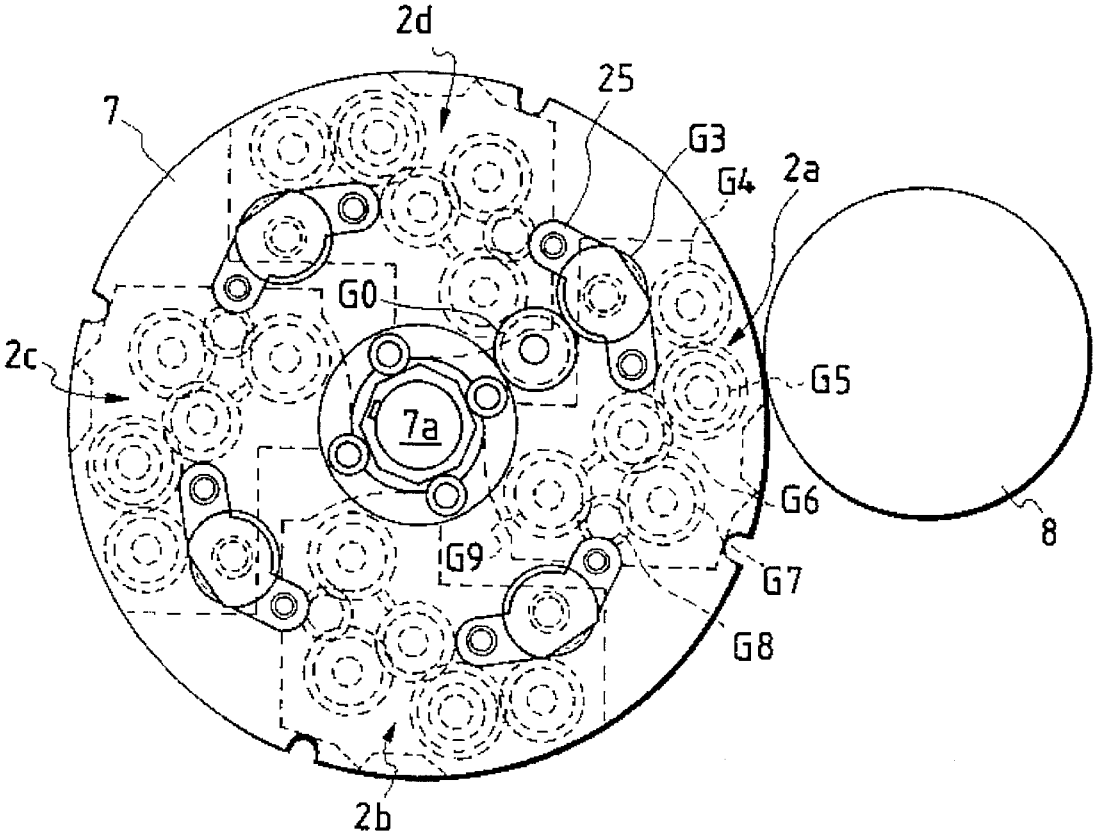
FIG. 12 PRIOR ART
FIG. 12 is a sectional view of the developing unit when seen from one side thereof.
Figure 13:
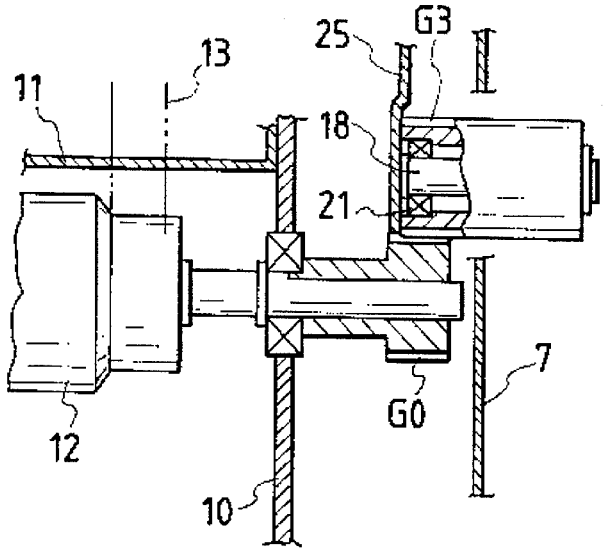
FIG. 13 PRIOR ART
FIG. 13 is a side view, partly in cross section, showing a drive system for the developing unit.
Figure 14:
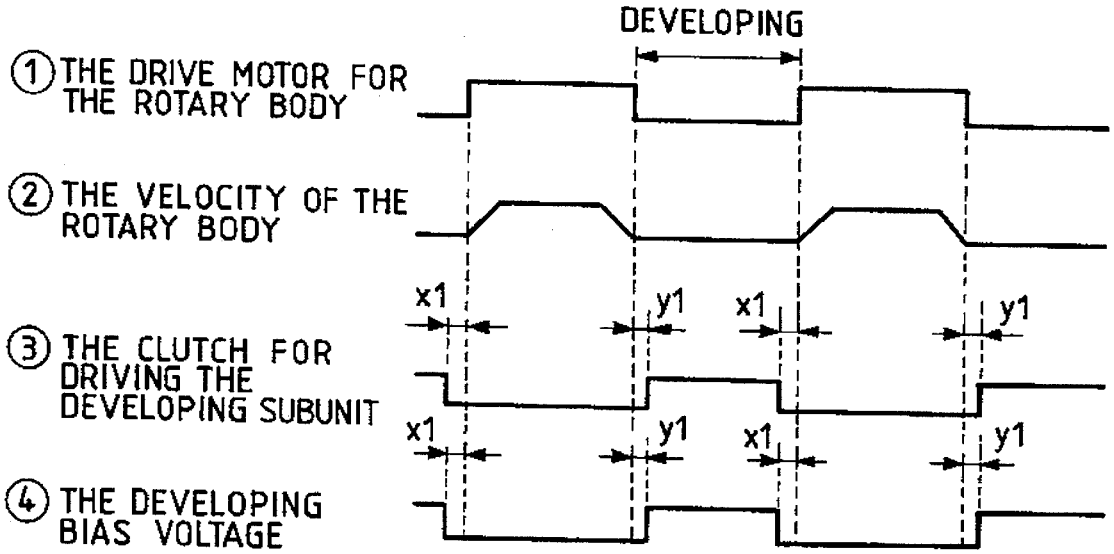
FIG. 14 PRIOR ART
FIG. 14 is a timing diagram showing the operation of the developing unit.

A modification of the drive system for the developing subunit is illustrated in FIGS. 10 and 11. FIG. 10 is a side view showing the modification of the drive system, and FIG. 11 is a front view, partly in cross section, showing the modified drive system for the developing subunit. The developing-subunit drive clutch 12 is put in a coupling state just before a developing subunit 2*a* reaches a developing position as the result of the turn of the rotary body 7. In this state, the drive gear G0 directly transmits a drive power to a developing-roll drive gear G5. To this end, the shaft 4*a* of the developing roll 4 is extended to outside of the rotary body 7. And a subgear G5' is mounted on the extended part of the shaft 4*a* of the developing roll 4. The center of the drive gear G0 lies on a straight line connecting the center P of the rotary body 7 to the center of the subgear G5'. G11 designates a drive gear for driving a developer dispenser auger, and G10 indicates a follower gear. It is noted that the bracket 25, and the follower gears G3 and G4, which are used in the embodiment of FIG. 7, are not used in the modification under discussion. This fact leads to cost reduction, simplification of the drive system, improvement of the drive force transmission efficiency, and reduction of the load to the main drive system.

Figure 16:
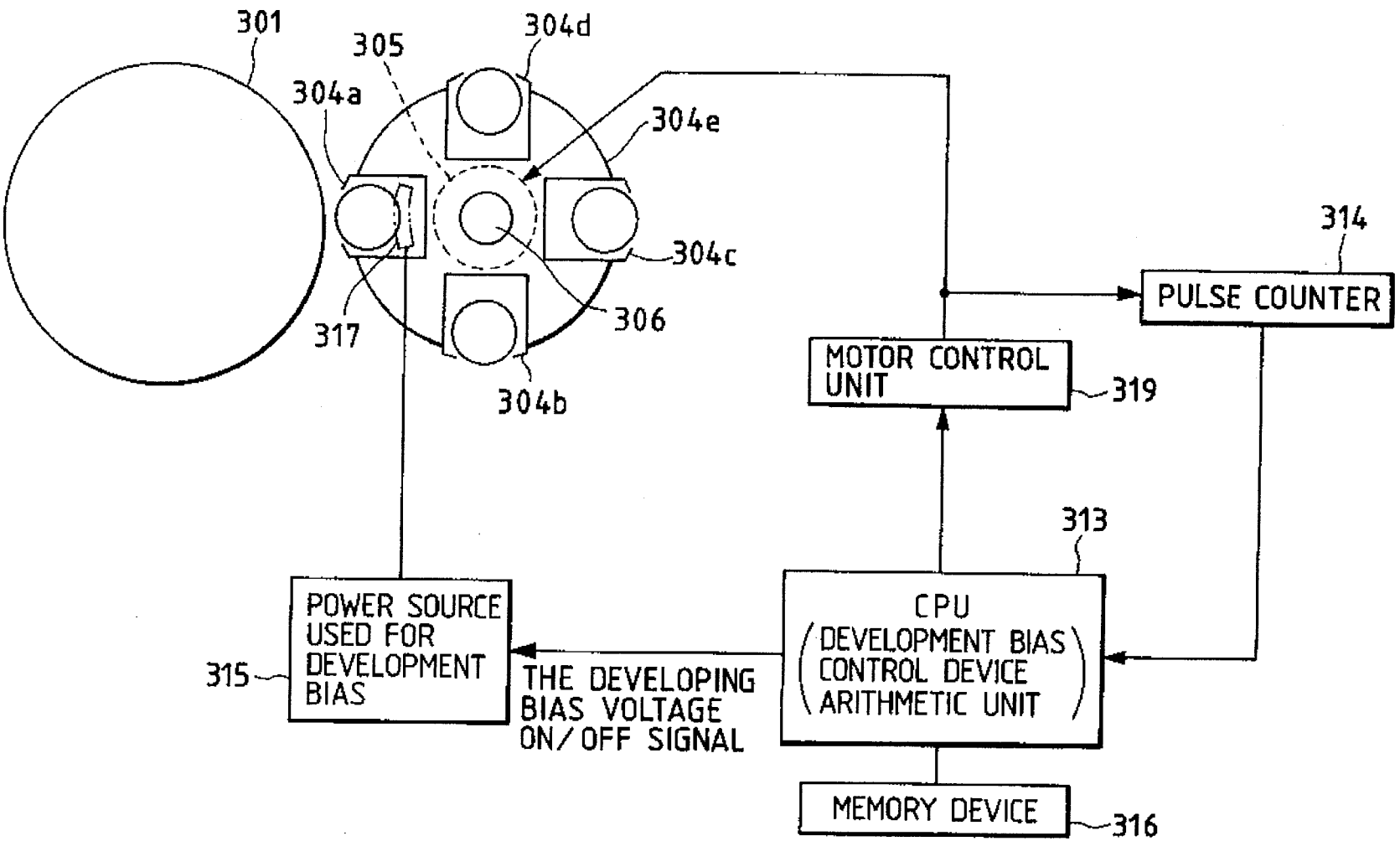
FIG. 16 is a view showing in schematic and block form a major portion of the image forming apparatus of FIG. 15.

In the construction of the developing unit 304, as shown in FIG. 16, the developing subunits 304*a* to 304*d* are mounted on the rotary body 304*e*. The rotary body 304*e* is driven to turn by a stepping motor 305. With rotation of the rotary body 304*e*, those developing subunits 304*a* to 304*d* are moved to successively face the image bearing means 301, to thereby perform the developing operation. A control system for the rotary developing unit includes a control unit 313, a pulse counter 314, a bias power source 315, a storage means 316, and a motor control unit 319. The control unit contains a CPU. The control unit will be representatively expressed merely as a CPU 313, for simplicity. The motor control unit 319 receives a signal from the CPU 313, and produces a motor control signal (pulse signal) for controlling the stepping motor 305 and the application of the developing bias voltage. The pulse counter 314 counts the number of pulses produced from the motor control unit 319. The storage means 316 stores the reference values for the controls by the CPU 313. The bias power source 315 produces a developing bias voltage in response to an on/off signal that is produced from the CPU 313. The output signal of the bias power source 315 is led to the electrode 317 connecting to the developing subunit, which faces the image bearing means 301.

The operation of the application of the developing bias voltage will be described.

A latent electrostatic image is formed on the surface of the image bearing means 301. In turn, the CPU 313 produces a control signal for transmission to the motor control unit 319. In response to the control signal, the motor control unit 319 applies a motor control signal to the bias power source 315. By the motor control signal, the bias power source 315 is turned to move the developing subunit containing the color of the latent image to the developing position and to stop it thereat. At this time, the image bearing means 301 is turned from a time point immediately before it reaches the developing position to another time point where its movement starts. The number of pulses of the motor control signal is counted by the pulse counter 314. The count is inputted to the CPU 313. The CPU 313 compares the count with a preset value that is read out of the storage means 316. The count by the pulse counter 314 represents a position of the developing subunit on the moving path thereof. If the result of the comparison shows the count by the pulse counter 314 is coincident with the preset value, which is representative of a position where the application of the bias voltage starts (referred to as a bias application start position), the CPU 313 sends an ON signal to the bias power source 315. In response to the ON signal, the bias power source 315 starts to apply a developing bias voltage through the electrode to the driven developing roll of the developing subunit, which faces the image bearing means 301. The image bearing means 301 approaches to the developing roll, and an electric field is formed between them. Upon completion of the developing operation, the stepping motor 305 is driven again, the pulse counter 314 counts the number of pulses from the motor control unit 319, and the bias power source 315 is controlled on the basis of the count by the pulse counter 314, to thereby produce an OFF signal.

Figure 17:
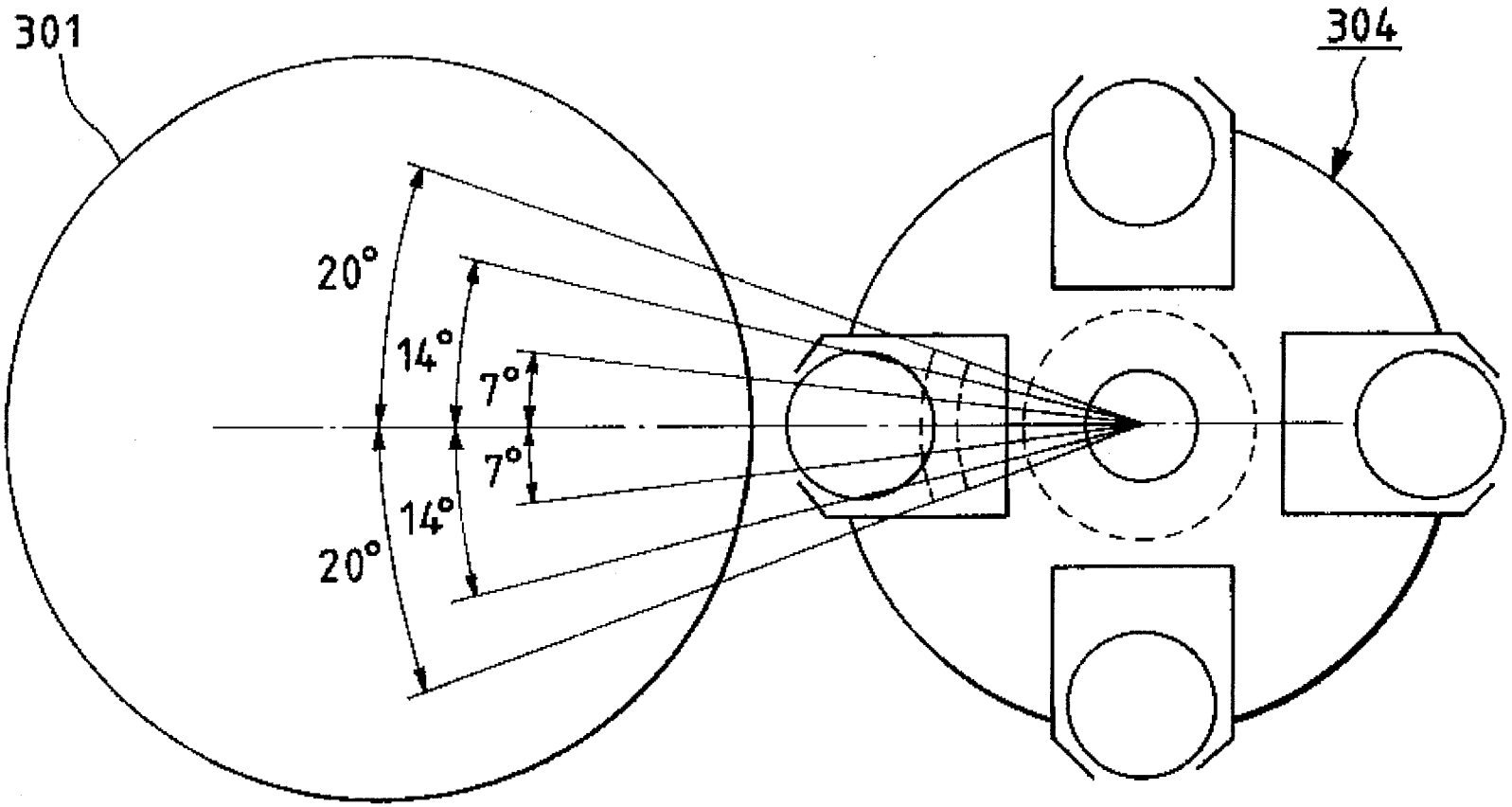
FIG. 17 is a view for explaining a rotation angle which provides the reference in controlling the timing of the application of the bias voltage.

The electrode, which is for applying the developing bias voltage to the developing subunit at the developing position, is located at a position within the range of approximately ±20° with respect to the developing position (FIG. 17). The electrode, when located thereat, applies the bias voltage only to the developing subunit at the developing position, without interrupting the operation of the developing unit. The application of the bias voltage starts after the developing subunit is within this range, the contact of the developing subunit is in contact with the electrode, and the bias voltage applying circuit is closed. And the application of the bias voltage is stopped before the bias voltage applying circuit is opened. If the bias voltage applying circuit is opened and closed in a state that the bias voltage is being applied, a discharge occurs, which adversely affects the controls of other components. To prevent the discharge, the application of the bias voltage is controlled as just mentioned. Additionally, it is necessary to apply the bias voltage when the developing subunit is within the range of ±7° with respect to the developing position. In a state that the bias voltage is applied when the developing subunit is present outside that range, if the developing roll approaches to the image bearing means 301, fogs are formed in the background of the reproduced image, and the movement of carriers takes place.

In the image forming apparatus used in the present embodiment, the developing unit is designed such that the bias voltage is applied when the developing subunit is located within the range of ±14° with respect to the developing position, in consideration with the above-mentioned conditions. When the developing unit is turned and the developing subunit approaches to the developing position, and reaches a position spaced 14° from the developing position, the application of the bias voltage starts. After the developing operation ends, the developing subunit leaves the developing position, and reaches a position spaced 14° away from the developing position. At this time, the application of the bias voltage is stopped. Approximately 60 msec is taken for the developing subunit to move from a position spaced 14° from the developing position before it reaches and stops at the developing position, to the developing position, and approximately 40 msec is taken for the developing subunit to move from a position 7° spaced from the developing position before it reaches the latter to the developing position where it stops. Approximately 80 msec is taken for the developing subunit to move from a position spaced 20° from the developing position before it reaches the latter to the developing position where it stops. Thus, the application of the developing bias voltage must be controlled in timing within the tolerance of ±20 msec, in order to satisfy the above-mentioned condition. It is noted here that the number of pulses for driving the stepping motor 305 is used for controlling the timing of the bias voltage application, in the present embodiment. Therefore, the position of the developing subunit on its moving path can be related with the bias voltage application timing, with a less error of approximately 10 msec. In other words, the timing of the bias voltage application timing can be controlled with an error of approximately 10 msec.

Even in a case where the speed of the rotary body 304*e* is varied in accordance with the paper size, the bias voltage application timing can exactly be controlled. It is noted further that the motor control signal, which exactly corresponds to the position of the developing subunit on its moving path, is used for controlling the bias voltage application timing. Therefore, the position of the developing subunit can exactly be detected irrespective of the motor load. The application of the bias voltage at a proper position is ensured. The resultant image is excellent in image quality, not having unwanted fogs and the like.

Figure 18:
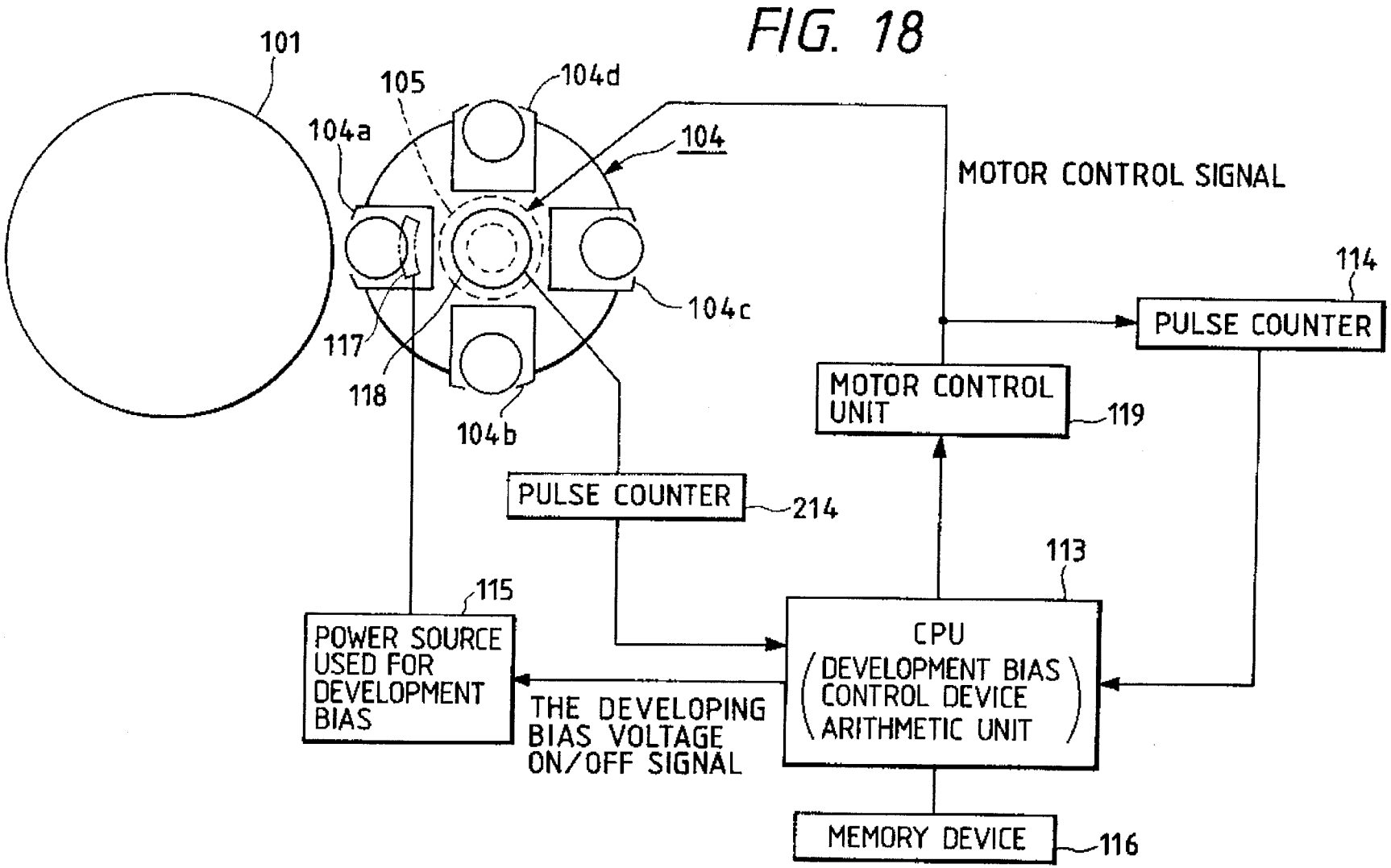
FIG. 18 is a view showing an image forming apparatus according to an embodiment of the invention as set forth in claim 2.

An image forming apparatus according to another embodiment of the present invention will be described with reference to FIGS. 18.

Figure 15:
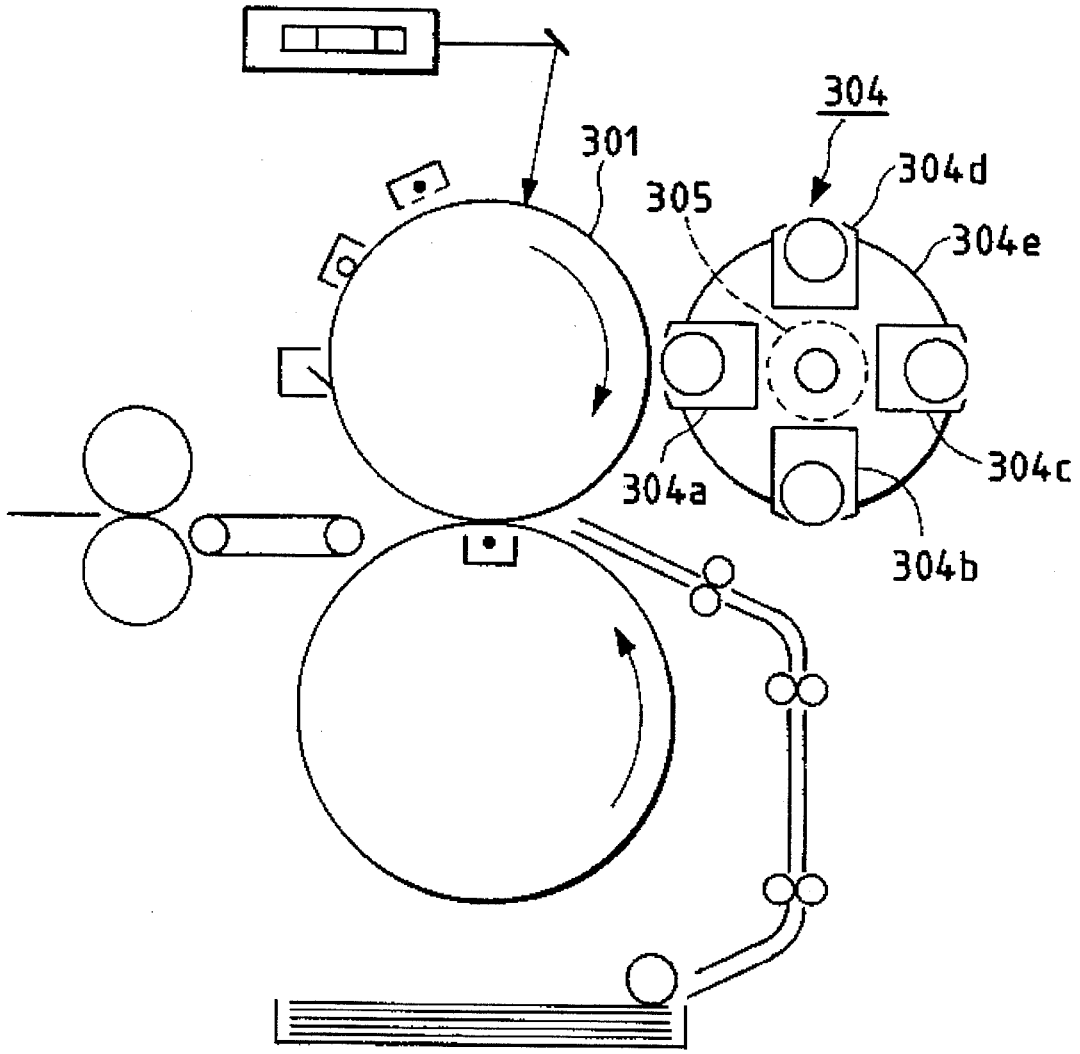
FIG. 15 is a view showing an image forming apparatus according to an embodiment of the invention as set forth in claim 1.

As shown, a rotary encoder 118 is mounted on the drive shaft of a stepping motor 105. The output signal of the rotary encoder 118 is counted by a pulse counter 214, and the result the counting is inputted to a CPU 113. The remaining construction of the image forming apparatus of the present embodiment is that of the image forming apparatus shown in FIGS. 15 and 16.

In the developing unit used in the present embodiment, the stepping motor 105 is operated in accordance with a motor control signal outputted from the CPU 113, as in the previous case, with rotation of the stepping motor 105, the developing subunits 104*a–d* mounted on the rotary body 104 move tracing a circular path. The number of pulses of the motor control signal is counted by the pulse counter 114, and the result of the counting is inputted to the CPU 113. The combination of the rotary encoder 118 and the pulse counter 214 detects a quantity of actual rotation of the stepping motor 105. The CPU 113 compares the actual rotation quantity with the count of the motor control signal from the pulse counter 114. After confirming that no difference is present between them, the CPU 113 compares it with a preset value representing a position of the developing subunit where the bias voltage is applied thereto, the preset value being read out of a storage means 116. If deciding that it is the bias voltage applying position, the CPU 113 outputs an ON signal to a bias power source 115 which is connected to an electrode 117 connected to the developing subunit facing the image bearing means 101.

The present embodiment is able to compare the actual rotation quantity with the count of the motor control signal from the pulse counter. Therefore, when an abnormal load acts on the stepping motor, and the rotation quantity of the stepping motor is deviated from the value indicated by the motor control signal to such an extent that the difference therebetween cannot be compensated for, it is possible to immediately stop the operation of the developing unit and/or the application of the bias voltage. If the difference between the actual rotation quantity and the preset value is within a compensative range, it can be compensated for in the next drive of the rotary body for rotation.

While the rotary encoder is coupled with the rotary shaft of the stepping motor, it may be coupled with the support shaft of the rotary body or a rotary shaft in a power transmission system for transmitting a drive force from the stepping motor to the rotary body.

As seen from the foregoing description, the present invention succeeds in providing a rotary developing unit which prevents developer from sticking onto the developer bearing means when the developer bearing means rolls to a standstill at the developing position and faces the photoreceptor while being in proximity with the latter, whereby eliminating the streak problem which otherwise would be caused in the developing stage.

The present image forming apparatus uses the stepping motor for driving the rotary body for rotation, counts the number of pulses of a control signal applied to the stepping motor, and controls the timing of the application of the bias voltage in accordance with the count value outputted from the pulse counter. Therefore, even if the rotation speed of the rotary body is varied in accordance with the paper size, for example, it is possible to know an exact position of the developing subunit, and to exactly control the application and removal of the developing bias voltage to and from the developing subunit, simultaneously with the drive of the developing roll. Thus, the rotary developing unit can apply the developing bias voltage to the developing subunit at a predetermined position of the developing subunit on its circular moving path. The resultant image is excellent in image quality, not having unwanted fogs and the like.

In a state that the developer bearing means faces the photoreceptor while being in proximity with the latter, the developer bearing means is rotating. Accordingly, the specific surface of the developer bearing means is not put in proximity with the photoreceptor for a long time. Further, there is eliminated such an unwanted situation that the photoreceptor potential causes toner to stick onto the developer bearing means when the developer bearing means is at a standstill. Accordingly, no streaks appear in a reproduced image.

The present image forming apparatus includes a rotation quantity detecting means for detecting a quantity of actual rotation of said rotary body or said stepping motor. The detect value from the rotation quantity detecting means is compared with a rotation quantity that is computed on the basis of the motor control signal inputted to the stepping motor. Therefore, when an abnormal load accidentally acts on the stepping motor, and the rotary body or the motor abnormally operates, it is possible to immediately detect such an abnormal operation. Accordingly, a quick measure can be taken for such an abnormality.

What is claimed is:

1. A rotary developing unit, comprising:

a rotary body, a plural number of developing subunits mounted on said rotary body, said developing subunits being moved to predetermined developing positions when said rotary body is turned about a rotary body center of rotation, a developer bearing means, said developer bearing means facing an image bearing means while being in the proximity of a developing position, and a drive means for driving said developer bearing means, said drive means including a drive gear for driving the developing subunit, a first follower gear in mesh with said drive gear; a second follower gear in mesh with said first follower gear, and a third follower gear located on at least one of said developing subunits, said second follower gear located between said third follower gear and said rotary body center of rotation when the at least one of said developing subunits is in a developing position, wherein said drive means continuously drives said developer bearing means for a period of time from a time point just before said developing subunit reaches a predetermined developing position and stops thereat to another time point immediately after said developing subunit leaves the developing position.

2. The rotary developing unit according to claim 1, further, comprising:

a stepping motor for driving said rotary body for rotation when said image bearing means is being driven for rotation;

a motor control unit for outputting a pulse signal to said stepping motor;

a pulse counter for counting the number of pulses applied to said stepping motor from said motor control unit; and means for applying a developing bias voltage to said image bearing means, the application of the bias voltage of said means being controlled to be in condition of ON/OFF in accordance with the count outputted from said pulse counter.

3. The rotary developing unit according to claim 2, further comprising:

a means for detecting the quantity of rotation of said rotary body or said stepping motor, and a means for computing the quantity of rotation of said rotary body or said stepping motor in accordance with the count of said pulse counter to compare the computed value with the detected quantity of rotation of said rotary body or said stepping motor.

4. The rotary developing unit according to claim 3, wherein when it is judged that it is out of a compensative range of values, on the basis of the computing result outputted from a computing means, the application of the bias voltage is stopped, and when it is judged that it is within the compensative range, it is compensated for in the next drive of the rotary body for rotation.

5. The drive device for a rotary developing unit according to claim 1, wherein said second follower gear is swung about the first follower gear.

6. The drive device for a rotary developing unit according to claim 1, wherein said second follower gear is urged against said first follower gear by means of a spring.

7. A rotary developing unit, comprising:

a rotary body, a plural number of developing subunits mounted on said rotary body, said developing subunits being moved to predetermined developing positions when said rotary body is turned about a rotary body center of rotation, a developer bearing means, said developer bearing means facing an image bearing means while being in the proximity of a developing position, and a drive means for driving said developer bearing means, said drive means including a drive gear located on one side of a follower gear, and a contact member located on the other side of the follower gear, said contact member forcing the follower gear into contact with the drive gear just before said developer subunit reaches a predetermined developing position and just after said developer subunit leaves the developing position, wherein said drive means continuously drives said developer bearing means for a period of time from a time point just before said developing subunit reaches a predetermined developing position and stops thereat to another time point immediately after said developing subunit leaves the developing position.

8. The rotary developing unit according to claim 7, further comprising:

a stepping motor for driving said rotary body for rotation when said image bearing means is being driven for rotation;

a motor control unit for outputting a pulse signal to said stepping motor;

a pulse counter for counting the number of pulses applied to said stepping motor from said motor control unit; and means for applying a developing bias voltage to said image bearing means, the application of the bias voltage of said means being controlled to be in condition of ON/OFF in accordance with the count outputted from said pulse counter.

9. The rotary developing unit according to claim 8, further comprising:

a means for detecting the quantity of rotation of said rotary body or said stepping motor, and a means for computing the quantity of rotation of said rotary body or said stepping motor in accordance with the count of said pulse counter to compare the computed value with the detected quantity of rotation of said rotary body or said stepping motor.

10. The rotary developing unit according to claim 9, wherein when it is judged that it is out of a compensative range of values, on the basis of the computing result outputted from a computing means, the application of the bias voltage is stopped, and when it is judged that it is within the compensative range, it is compensated for in the next drive of the rotary body for rotation.

11. A rotary developing unit, comprising:

a rotary body, a plural number of developing subunits mounted on said rotary body, said developing subunits being moved to predetermined developing positions when said rotary body is turned, a developer roll having a shaft extending therefrom and a follower gear attached thereto, said developer roll facing an image bearing means while being in the proximity of a developing position, and a drive means for driving said developer roll, said drive means including a drive gear, and said follower gear meshes with said drive gear just before said developing subunit reaches a predetermined developing position, while said developing subunit is in the developing position, and just after said developing subunit leaves the developing position, wherein said drive means continuously drives said developer bearing means for a period of time from a time point just before said developing subunit reaches a predetermined developing position and stops thereat to another time point immediately after said developing subunit leaves the developing position.

12. The rotary developing unit according to claim 11, further comprising:

a stepping motor for driving said rotary body for rotation when said image bearing means is being driven for rotation;

a motor control unit for outputting a pulse signal to said stepping motor;

a pulse counter for counting the number of pulses applied to said stepping motor from said motor control unit; and means for applying a developing bias voltage to said image bearing means, the application of the bias voltage of said means being controlled to be in condition of ON/OFF in accordance with the count outputted from said pulse counter.

13. The rotary developing unit according to claim 12, further comprising:

a means for detecting the quantity of rotation of said rotary body or said stepping motor, and a means for computing the quantity of rotation of said rotary body or said stepping motor in accordance with the count of said pulse counter to compare the computed value with the detected quantity of rotation of said rotary body or said stepping motor.

14. The rotary developing unit according to claim 13, wherein when it is judged that it is out of a compensative range of values, on the basis of the computing result outputted from a computing means, the application of the bias voltage is stopped, and when it is judged that it is within the compensative range, it is compensated for in the next drive of the rotary body for rotation.

15. A rotary developing unit, comprising:

a rotary body, a plural number of developing subunits mounted on said rotary body, said developing subunits being moved to predetermined developing positions when said rotary body is turned, a developer bearing means, said developer bearing means facing an image bearing means while being in the proximity of a developing position, a drive means for driving said developer bearing means, wherein said drive means continuously drives said developer bearing means for a period of time from a time point just before said developing subunit reaches a predetermined developing position and stops thereat to another time point immediately after said developing subunit leaves the developing position, a stepping motor for driving said rotary body for rotation when said image bearing means is being driven for rotation, a motor control unit for outputting a pulse signal to said stepping motor, a pulse counter for counting the number of pulses applied to said stepping motor from said motor control unit, and means for applying a developing bias voltage to said image bearing means, the application of the bias voltage of said means being controlled to be in condition of ON/OFF in accordance with the count outputted from said pulse counter.

16. The rotary developing unit according to claim 15, further comprising:

a means for detecting the quantity of rotation of said rotary body or said stepping motor, and a means for computing the quantity of rotation of said rotary body or said stepping motor in accordance with the count of said pulse counter to compare the computed value with the detected quantity of rotation of said rotary body or said stepping motor.

17. The rotary developing unit according to claim 16, wherein when it is judged that it is out of a compensative range of values, on the basis of the computing result outputted from a computing means, the application of the bias voltage is stopped, and when it is judged that it is within the compensative range, it is compensated for in the next drive of the rotary body for rotation.

18. The drive device for a rotary developing unit according to claim 15, wherein said drive means includes a gear for driving the developing subunit, said drive gear being disposed outside of said rotary body, a first follower gear in mesh with said drive gear, and a second follower gear in mesh with said first follower gear, wherein a drive force is transmitted from said drive gear to said second follower gear, and said second follower gear is swung about the first follower gear.

19. The drive device for a rotary developing unit according to claim 18, wherein said second follower gear is urged against said first follower gear by means of a spring.

* * * * *